United States Patent [19]

Papanikolaou

[11] Patent Number: 4,473,943

[45] Date of Patent: Oct. 2, 1984

[54] ILLUMINATED RAZOR

[76] Inventor: Sotirios Papanikolaou, 407 Church St., Hasbrook Heights, N.J. 07604

[21] Appl. No.: 425,712

[22] Filed: Sep. 28, 1982

[51] Int. Cl.[3] ..... B26B 19/46

[52] U.S. Cl. ..... 30/34 R; 30/86

[58] Field of Search ..... 30/34 R, 86, 123, 70; 43/17.5

[56] References Cited

U.S. PATENT DOCUMENTS

| | | | |
|---|---|---|---|
| 1,180,686 | 4/1916 | Allport . | |
| 1,591,627 | 7/1926 | Hopkins | 43/17.5 X |
| 1,900,965 | 3/1933 | Weiss . | |
| 2,546,928 | 3/1951 | Masabny | 30/70 |
| 3,121,286 | 1/1964 | Schneiderman | 30/34 R |
| 3,740,887 | 6/1973 | Van Leeuwen | 43/17.5 |
| 3,811,188 | 5/1974 | Brenneman | 30/34 R |
| 4,094,062 | 6/1978 | Papanikolaou | 30/34 R |

FOREIGN PATENT DOCUMENTS

| | | | |
|---|---|---|---|
| 878882 | 11/1942 | France | 30/34 R |
| 887027 | 1/1962 | United Kingdom | 30/34 R |

*Primary Examiner*—Jimmy C. Peters

*Attorney, Agent, or Firm*—Hedman Gibson Costigan & Hoare

[57] ABSTRACT

An illuminated razor includes a head portion for holding a razor blade formed of a substantially transparent material, a handle secured to the head portion, a cavity inside the razor, a light bulb and a power source both within the cavity, and switch means adapted to selectively turn the light bulb on or off in response to a rotation of the handle relative to the head portion. The handle comprises a generally hollow cylinder open only at one end and having no other apertures therethrough, thereby securely and reliably sealing the cavity inside the razor from the external environment.

8 Claims, 5 Drawing Figures

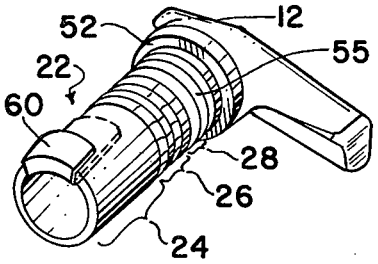
FIG. 5
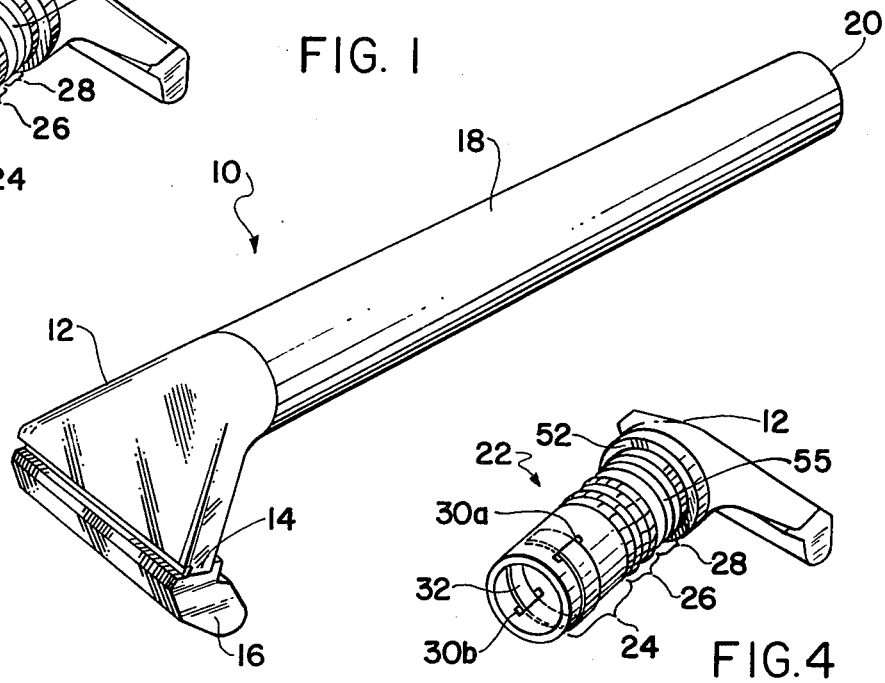
FIG. 1
FIG. 4
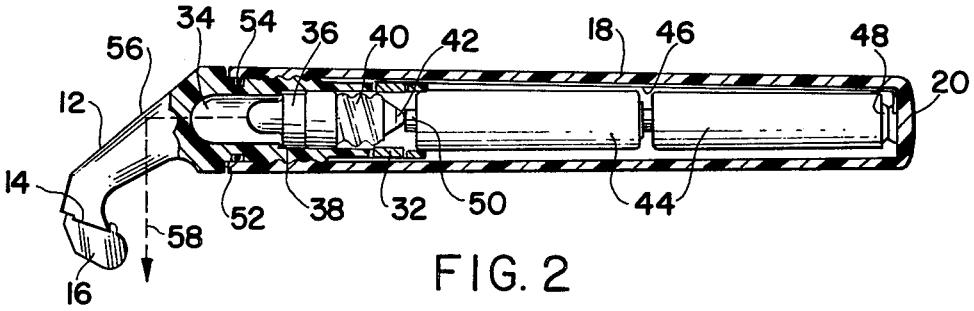
FIG. 2
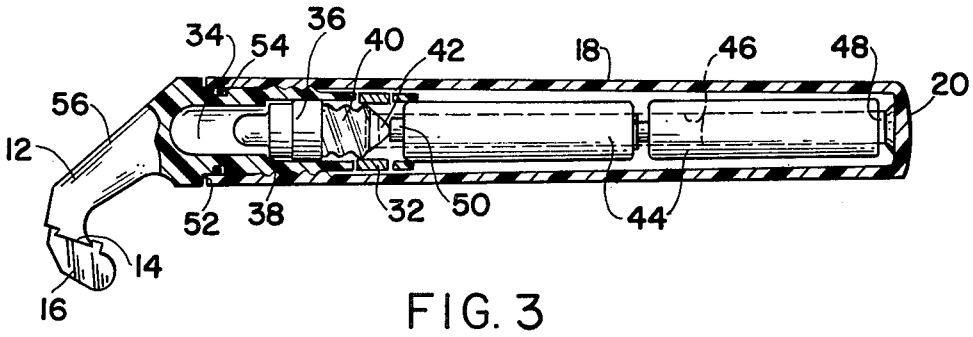
FIG. 3

ILLUMINATED RAZOR

BACKGROUND OF THE INVENTION

The present invention is directed to the field of razors and more particularly to a razor having provisions for lighting the shaving area.

Presently, it is customary to use various types of razors, such as electric razors, safety razors, straight razors, and the like. Many of these razors are afforded with sophisticated safety provisions, one of the more important of which is the provision for lighting the shaving area. Some of the early razors which employed means for illuminating the shaving area are disclosed in U.S. Pat. No. 1,180,686 by Allport, and U.S. Pat. No. 2,546,928 by Masabny. However, these razors are bulky, cumbersome objects which lack light directivity. Additionally, in view of the typical shaving environment, the prior art razors required elaborate sealing provisions to avoid electrical shorting of the electrical components therein.

An illuminated razor which mitigates many of the above-described shortcomings is disclosed in U.S. Pat. No. 4,094,062 issued to Papanikolaou, the inventor of the present invention. The razor disclosed therein is compact and is provided with a razor head formed of a transparent plastic material contoured so as to act as a light pipe to thereby illuminate the area just previously shaved. Although the razor described therein represents a significant advance in the art, further improvements in the construction of the razor are desirable. In particular, a slidable switch is provided in the U.S. Pat. No. 4,094,062 for selectively turning a light bulb on and off, and a removable end portion is also provided to allow access to the battery chamber. Thus, two sealing mechanisms, one for the switch and one for the end portion, are required.

OBJECTS AND SUMMARY OF THE INVENTION

It is therefore an object of the present invention to provide a razor which further avoids the shortcomings of the prior art devices.

It is a further object of the invention to provide an illuminated razor which is less bulky and cumbersome than the prior art devices.

It is a further object of the invention to provide an illuminated razor which requires only a single sealing device.

An illuminated razor in accordance with the present invention comprises a head portion adapted to hold a razor blade and formed of a substantially transparent material, a handle secured to the head portion, a cavity inside the razor, a light bulb and a power source both within the cavity, and switch means adapted to selectively turn the light bulb on or off in response to a rotation of the handle relative to the head portion.

Specifically, the handle comprises a generally hollow cylinder opened at only one end and having no other apertures therethrough, to thus securely and reliably seal the cavity inside the razor from the external environment. An O-ring seal may be provided between the head portion and the cylinder for this purpose. The switch means allows the bulb to be switched on or off with a rotation of the handle relative to the head portion of less than 180°.

BRIEF DESCRIPTION OF THE DRAWINGS

These and other objects, aspects and embodiments of the invention will be described with reference to the following drawing figures of which:

FIG. 1 is a perspective view of the illuminated razor in accordance with the present invention;

FIG. 2 is a cross-sectional view of the illuminated razor in an ON state;

FIG. 3 is a cross-sectional view of the illuminated razor in an OFF state;

FIG. 4 is a detailed perspective view of the razor head and barrel, and

FIG. 5 is a detailed perspective view of an alternative design for the razor barrel.

DETAILED DESCRIPTION OF THE INVENTION

The illuminated razor 10 in accordance with the present invention is shown in perspective in FIG. 1. The head 12 of the razor is formed of transparent or translucent material such as acrylic, LUCITE, or other suitable clear plastic. Preferably, the head 12 is acrylic and formed by injection molding. The head 12 is provided at the terminal portion thereof with a fitting 14 which is adapted to slidably receive a standard double edge blade carrier 16 well known in the art. The other end of the head 12 is threadedly secured to a handle 18 formed of a plastic material such as polypropylene. As with the head 12, the handle 18 is preferably formed by injection molding. The handle 18 is in the form of a tapered cylinder and has no openings along the cylindrical portion thereof, and the terminal end 20 of the handle 18 is integrally formed with the cylindrical portion of the handle, thus permanently sealing the interior portion of the handle from the environment. Those skilled in the art will appreciate that the razor need employ but a single seal between the head 12 and handle 18.

The details of the internal construction of the illuminated razor will now be described with further reference to FIGS. 2–4. With specific reference to FIG. 4, the head 12 is provided with a barrel 22 integrally formed with the head 12. The barrel 22 is comprised of ground contact portion 24, threaded portion 26 adjacent to the contact portion 24, and a sealing portion 28 disposed between the threaded portion 26 and the head 12.

The ground contact portion 24 is provided with two diametrically opposed slots **30*a* and 30*b* through which ground contact 32 is disposed. Specifically, ground contact 32 is comprised of a ring of metallic material having a circumference about the same as the circumference of the ground contact portion 24. The ground contact 32 is inserted into the slots 30*a* and 30*b* such that the ground contact 32 surrounds the exterior of the ground contact portion 24 on one side of the ground contact portion, and is disposed on the interior of the ground contact portion 24** on the other side thereof.

As best shown in FIGS. 2 and 3, the barrel 22 is provided with a centrally disposed cavity 34 along the axis of the barrel 22. The cavity 34 is sized to allow a standard light bulb 36, such as a GE 222, or equivalent, to be disposed therein. The cavity 34 is provided with an annular abutment 38 to prevent axial movement of the bulb 36 toward head 12, once the razor is assembled. By providing the abutment 38, the hot portion of bulb 36 will not be in contact with any plastic material. The bulb 36 is provided with a standard threaded ground terminal 40 and a positive terminal 42. The ground contact portion 24 of the barrel 22 is adapted to fit closely, but not tightly about the ground terminal 40. Rather, the ground terminal 40 is held captive by the portion of the ground contact ring 32 which extends into the interior of the ground contact portion 24. In this manner, the bulb 36 is further secured within the cavity 34, and an electrical connection is effected between the ground terminal 40 and the ground contact ring 32.

The interior of the handle 18 is essentially hollow and is adapted to house a pair of small batteries 44, such as the Mallory AAA Duracell, or equivalent. Fixed to the interior wall of the handle 18 is a ground lead 46 comprised of a strip of metal which is bent at the end 20 of the handle 18 in order to establish contact with the negative terminal 48 of the second of the batteries 44. The ground lead 46 is held in place by ribs along the interior wall of the handle 18, or by other suitable means, and extends along the interior wall of the handle 18 up to, and coextensive with the ground contact ring 32. The positive terminal 42 of the bulb 36 is in contact with the positive terminal 50 of the first of the batteries 44. The handle 18 extends substantially all the way to an annular abuttment 52 on the head 12, extending beyond and covering the sealing portion 28 (FIG. 4). A resilient O-ring 54 is provided within recess 55 in the sealing portion 28 to thereby establish a highly secure and water tight seal between the interior portions of the razor and the external environment.

In operation, the light bulb 36 may be activated by twisting handle 18 relative to head 12 to thereby place the razor in the position illustrated in FIG. 2. In this position, the ground lead 46 will effect an electrical connection between the ground terminal 48 of the second of the batteries 44 and the ground terminal 40 of the bulb via the ground contact ring 32. Since the positive terminal 50 of the batteries 44 is in contact with the positive terminal 42 of the light bulb 36, the circuit will be complete and the bulb will be lit. By providing head 12 made of a clear plastic material, the head 12 can act as a "light pipe", directing the light from the bulb 36 to the area being shaved. Moreover, by providing the contour for the head 12 illustrated in the figures, the light rays can be reflected off surface 56 and directed to the area being shaved as illustrated by the dashed line 58. Other contours for the head 12, such as that illustrated in U.S. Pat. No. 4,094,062, may be employed in conjunction with the present invention, if desired.

When it is desired to deactivate the bulb 36, the user need only turn the handle 18 relative to the head 12 such that the ground lead 46 is in the position illustrated in FIG. 3. When so positioned, the ground lead 46 will be over the ground contact portion 24 where the ground contact ring 32 is disposed on the inside thereof, thus opening the circuit between the ground lead 46 and the ground contact ring 32.

As will be readily appreciated by those skilled in the art, the above-described illuminated razor provides an extremely secure and reliable seal between the internal portions of the razor and the usually wet external environment. Since the bulb may be switched on and off by a slight rotation of the handle, the handle 18 can be a completely solid structure with no holes, slots or the like therethrough, except for the opening into which the barrel 22 is disposed. Thus, only a single, highly secure O-ring 54 need be used to provide a highly reliable seal. Since only a slight rotation of the handle 18 is required, the handle 18 always extends over and forms a seal with the O-ring 54. On the other hand, when necessary for replacement of the bulb 36 or batteries 44, the handle 18 can readily be removed from the head 12 by completely unthreading the members.

The ground contact can also be provided by a "V" shaped metallic contact 60, FIG. 5, rather than the ring 32, if desired. The contact 60 can be slipped onto the portion 24 such that a part of the contact 60 resides on the interior of portion 24, and a part resides on the exterior as well. As with ring 32, the electrical connection will be effected between ground lead 46 and the ground terminal 40 by placing the ground lead 46 in registry with contact 60. The bulb can be turned off by slightly twisting the handle 18 relative to the barrel 22 to disconnect the lead 26 from the contact 60.

Those skilled in the art will also appreciate that the construction of the illuminated razor in accordance with the present invention is significantly less espensive than the prior art illuminated razors. The switch formed by the ground contact ring 32, or the contact 60, and ground lead 46 merely requires two stamped pieces of metal. Despite the low cost of such arrangement, the switching mechanism is highly reliable and completely contained within the handle 18 such that no holes, slots or the like are required therethrough.

Although the present invention has been described with reference to the foregoing specification and drawings, many modifications additions and deletions thereto may be made to the invention without departing from the spirit and scope thereof. The scope of the invention will now be defined with reference to the following claims.

What is claimed is:

1. A razor comprising:

a razor head adapted to hold a razor blade and formed of a substantially transparent material;

a threaded barrel connected to the razor head;

a threaded handle adapted to threadedly engage the threaded barrel, at least one of said handle and said barrel being hollow so that a cavity is formed inside the razor when the barrel engages the handle;

a light bulb having first and second terminals and adapted to be disposed within the cavity;

at least one power source having associated first and second terminals and adapted to be disposed within the cavity;

a first contact within said cavity adapted to be in contact with the first terminal of the light bulb, said first contact being fixed to one of the barrel and handle;

a second contact within the cavity adapted to be in contact with the first terminal of the power source, said second contact being fixed to the other of the barrel and handle;

the second termianls of the light bulb and the power source adapted to be in electrical contact with each other, whereby electrical contact between the first and second contacts can selectively be formed and discontinued by rotating one of the handle or barrel with respect to the other to thus selectively turn the lightbulb on or off.

2. The razor of claim 1 wherein the barrel is adapted to be threaded into the interior of the handle.

3. The razor of claim 2 wherein said handle comprises a generally hollow cylinder opened at only one end and having no other apertures therethrough.

4. The razor of claim 3 wherein an O-ring seal is provided between the handle and the barrel.

5. The razor of claim 4 wherein the first terminals of the light bulb and power source are the ground terminals, and the first contact is fixed to the barrel.

6. The razor of claim 5 wherein the first contact is a ring of metal a first portion of which is disposed about the outside of the barrel and a second portion of which is disposed inside the barrel.

7. The razor of claim 5 wherein the first contact is a "V" shaped piece of metal a first portion of which is disposed about the outside of the barrel and a second portion of which is disposed inside the barrel.

8. The razor of either of claims 6 or 7 wherein the second contact is a strip of metal extending along the interior surface of the hollow cylinder and disposed outside of the barrel.

* * * * *